United States Patent [19]

Thrower

[11] 4,429,816

[45] Feb. 7, 1984

[54] UNION FOR PROVIDING INERT GAS BETWEEN TEEMING NOZZLE AND POURING TUBE

[75] Inventor: Anthony Thrower, Dronfield, England

[73] Assignee: USS Engineers and Consultants, Inc., Pittsburgh, Pa.

[21] Appl. No.: 351,822

[22] Filed: Feb. 24, 1982

[30] Foreign Application Priority Data

Mar. 3, 1981 [GB] United Kingdom ..... 8106587

[51] Int. Cl.[3] ..... B22D 41/08

[52] U.S. Cl. ..... 222/603; 222/606; 164/415; 164/475

[58] Field of Search ..... 222/603, 600, 606, 607; 266/218, 220, 265, 271, 272; 164/66.1, 259, 415, 475

[56] References Cited

U.S. PATENT DOCUMENTS

| | | | |
|---|---|---|---|
| 4,042,007 | 8/1977 | Zavaras | 164/475 X |
| 4,275,825 | 6/1981 | King et al. | 222/606 X |

FOREIGN PATENT DOCUMENTS

| | | | |
|---|---|---|---|
| 228418 | 7/1963 | Austria | 164/415 |
| 229755 | 3/1967 | U.S.S.R. | 164/259 |
| WO82/01836 | 6/1982 | PCT Int'l Appl. | 222/603 |

*Primary Examiner*—David A. Scherbel
*Attorney, Agent, or Firm*—John F. Carney

[57] ABSTRACT

In submerged teeming operations the extended pouring tube which receives molten metal from a vessel via a nozzle has gas admitted thereto for protecting it against molten metal attack. A union block is sandwiched between the nozzle and pouring tube, block being surrounded by a metal jacket spaced therefrom to form a gas manifold to be fed with gas via a gas supply pipe. Gas admitted to the manifold is ejected, around the lower end of the union block, by a surrounding annular orifice into the pouring tube and flows downwardly along the wall thereof as a protective gas film.

10 Claims, 1 Drawing Figure

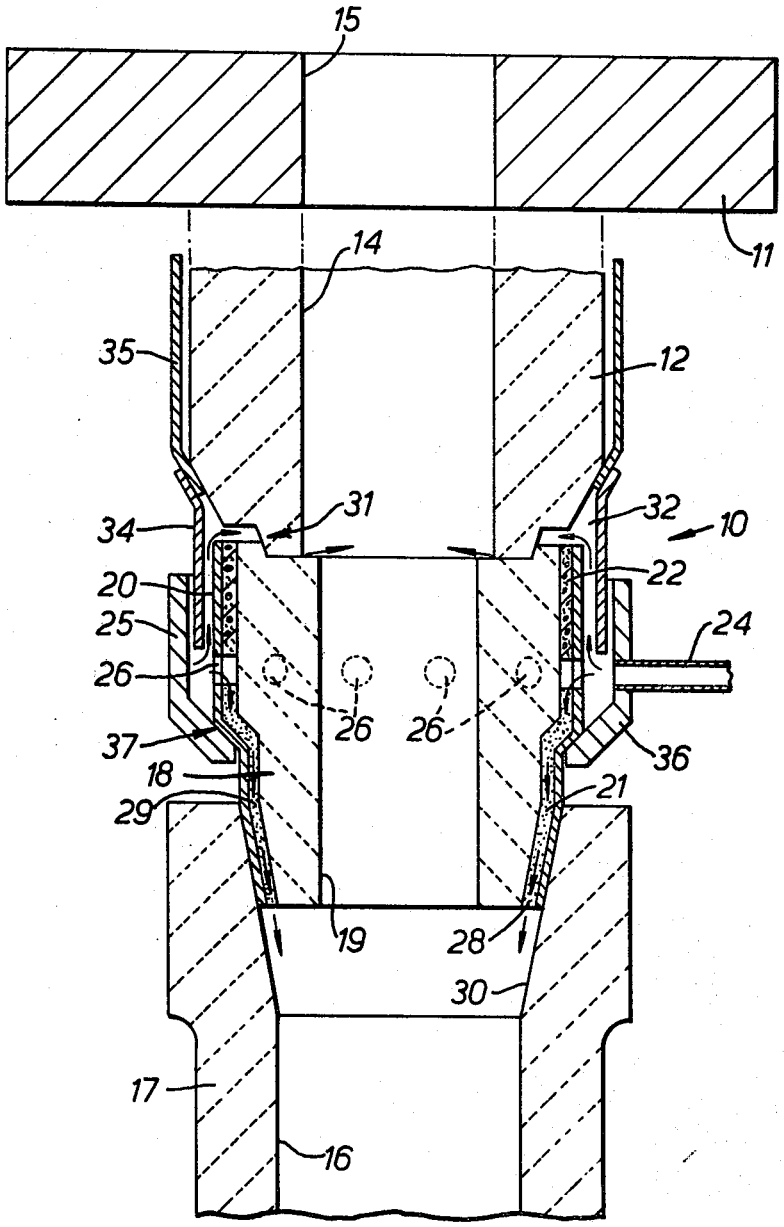
15
11
14
35
12
31
32
10
34
22
20
24
25
26
26
26
37
36
18
21
29
19
28
30
17
16

UNION FOR PROVIDING INERT GAS BETWEEN TEEMING NOZZLE AND POURING TUBE

BACKGROUND OF THE INVENTION

The present invention relates to improvements in the pouring of molten metals.

It is often desirable during teeming to isolate, as far as possible, molten metal streams from the ambient air to avoid excessive oxidation. In continuous casting, for example, submerged pouring techniques may be adopted. Thus, the molten metal from the teeming ladle may be conducted into the tundish, and/or from the tundish into the mould via an elongated pouring tube which has its lower end submerged beneath the melt surface in the tundish and/or the mould. In common with other tubes or nozzles through which the teeming metal passes, as well as gate valve plates, the elongated pouring tubes are made from refractory materials. Such components are costly in terms of the refractory materials and energy requirements needed to produce them, and attention is turning to production techniques which minimise or avoid the need for high firing temperatures. In the result, there has been a tendency to try materials of rather low refractoriness, including silica, and special concretes. A drawback of such materials is that the molten metal erodes or chemically attacks them quite quickly, and if they are of high thermal conductivity impurities from the molten metal mey build up thereon. Accretion of solids may become quite serious, depending on the metal or alloy to be teemed and the length of the pouring tube. In either event, the useful life of refractory items is undesirably limited.

SUMMARY OF THE INVENTION

Gas injection has been proposed as a means of protecting or isolating refractories from molten metal. What has hitherto been sought is a protective gas film between the metal stream and the bore of a nozzle. The present invention is aimed to develop such a film in the elongated pouring tube to extend its useful life, and the invention provides a convenient assembly for introducing the gas. The gas will usually be inert, for example argon.

The invention is particularly advantageous for protecting pouring tubes of low refractoriness, but is equally useful in protecting higher fired refractories in view of their greater costs and their own lack of immunity from molten metal attack.

According to the present invention, there is provided apparatus for use in the submerged pouring of molten metals, comprising a nozzle, an elongated submerged pouring tube downstream of the nozzle and an orificed refractory block forming a union therebetween, the union block having a surrounding metal jacket spaced therefrom to define an annular manifold space, with which a gas supply pipe communicates, and a gas discharge orifice or orifices at a downstream end of the union block, the union block and its metal jacket forming a gas-tight joint with the upstream end of the pouring tube, and the said orifice or orifices being arranged to eject gas fed into the manifold space in a downstream direction substantially along the inner wall of the pouring tube.

Conceivably, the union block and its jacket taper inwardly in the downstream direction, and are gas-tightly received in a flared opening at the upstream end of the pouring tube.

In a preferred embodiment, the metal jacket defines a single ring-shaped orifice and the manifold space contains a filling of gas-porous material, which may comprise a fibrous ceramic substance or other porous packing.

The nozzle and union block may interfit by way of a stepped joint, when advantageously means will be provided to convey gas fed by the gas supply pipe to the region around the joint. By this means it is possible to minimize the sucking in of air through the joint.

Molten metal attack of the nozzle is often severe, especially if a flow control slide gate valve atop the nozzle is in a throttling setting. To lessen attack, the nozzle is often made of or lined with a costly highly refractory material such as fired zirconia. By means of the union block, the length of the costly nozzle may be minimised, the union block being a readily-replaceable nozzle extension. The block can be made of inexpensive refractory material.

For some applications, the union block might be unnecessary, when the nozzle itself will be arranged to receive and eject gas into the pouring tube.

Accordingly, the present invention further provides apparatus wherein the nozzle and its jacket taper inwardly in the downstream direction, and are gas-tightly received in a flared opening at the upstream end of the pouring tube.

Most conveniently, the nozzle is attached to the downstream one of the cooperating valve plates of a sliding gate valve.

BRIEF DESCRIPTION OF THE DRAWING

The invention will now be described in more detail by way of example with reference to the sole accompanying drawing, which is a longitudinal sectional view of a nozzle and submerged pouring tube combination in accordance with the invention.

DESCRIPTION OF A PREFERRED EMBODIMENT OF THE INVENTION

The pouring apparatus 10 is shown attached to the lowermost or downstream valve plate 11 of a sliding gate valve. In a two plate valve, plate 11 is of course the sliding gate. The various forms of sliding gate valve are by now well known and no description thereof need be given here.

Apparatus 10 includes a nozzle 12 having its bore 14 in registry with the plate orifice 15. Nozzle bore 14 leads downstream to the passage 16 of an elongated submerged pouring tube 17.

An orificed union block 18 is sandwiched between nozzle 12 and pouring tube 17. Orifice 19 of the block 18 is coaxial with bore 14 and passage 16.

Nozzle 12, union block 18 and pouring tube 17 are made from refractory materials and at least the nozzle and union block are encased in metal jackets. Desirably the pouring tube 17 is metal jacketed too.

The metal jacket 20 encasing the union block 18 is spaced therefrom to define a surrounding annular manifold space 21. The spaced relationship between jacket 20 and union block 18 is maintained by a ring of cement 22 uniting the two around the top or upstream end of the union block. To feed gas to the manifold space 21, there is a gas supply pipe 24 which is borne by an attachment ring 25 disposed outwardly of the jacket 20. As will be described, the attachment ring secures the union block 18 to the downstream end of the nozzle 12. In use, gas enters the manifold space 21 through a plurality of circumferentially-spaced openings 26 distributed about the jacket 20.

At the downstream end, the jacket 20 and union block 18 define an annular gas-ejecting orifice 28. If desired, the jacket 20 could have internal ribs or other inward projections to maintain its lower end uniformly spaced from the union block. Such ribs or projections can result in the formation of a ring of gas-ejecting orifices.

The manifold space 21 can contain a filling of gas-porous material 29 such as a fibrous ceramic substance or porous cementitious mass. The filling will aid uniform distribution of gas to the orifice(s) 28.

The union block 18 and its jacket 20 form a gas tight joint with the upstream end of the passage 16 of the pouring tube 17. Gas tightness is most easily attained if the block 18 and jacket 20 are frusto-conically tapered at their lower ends, and the pouring tube 17 has a matingly-flared mouth opening or 30 at its upstream end. In use, it is likely that the tube 16 will fill substantially completely with molten metal, which may cause the jacket 20 to fuse to the mouth 30 and thereby ensure gas tightness.

When gas is admitted under pressure to the manifold space 21, it is ejected from the orifice(s) 28 in a direction which is along the wall of the passage 16. The gas tends to hug the wall and provides a protective film between the wall and metal flowing down the passage 16.

The joint 31 between the nozzle 12 and the union block 18 is of conventional stepped form. Air tends to be aspirated through such a joint and to mitigate this means is provided to convey gas fed through the pipe 24 to the joint 31. The said means comprises an annular space 32 between metal jacket 20 and an encircling downward extension 34 of the metal jacket 35 of the nozzle 12. The annular space 32 encircles the joint 31 and some of the gas fed by the pipe 24 flows into this space, the remainder flowing into manifold space 21. Gas in use traversing the joint 31 may provide a protective film about the wall of orifice 19.

The downward extension 34 is welded to jacket 35 and serves a second purpose which is in securing the union block 18 to the nozzle 12. Thus, extension 34 is one half of a coupling means, the other half of which is the attachment ring 25. The latter has an inturned lip 36 which engages an external shoulder 37 around the union block. Coupling of the parts 34 and 25 may rely on screw threads or preferably a bayonet connection.

As drawn, a substantial clearance appears between the attachment ring 25 and the extension 34. In practice, this clearance will be small and leakage of gas fed into the region between the ring 25 and jacket 20 will be minimal. A sealant could be utilised to prevent leakage via the said clearance.

Tube 17 will be supported beneath the nozzle in any convenient manner.

If desired, apparatus 10 can be associated with a stopper rod flow control system instead of a sliding gate valve, and in some tundish teeming operations need not be associated with any flow control system.

I claim:

1. Apparatus for use in the submerged pouring of molten metals including a nozzle, an elongated submersible pouring tube downstream of said nozzle and means forming a union therebetween, said union comprising:

(a) a block of refractory material having a longitudinal aperture for communication between said nozzle and said pouring tube;

(b) a metal jacket surrounding said refractory block in spaced relation therefrom to define an annular manifold space;

(c) gas supply means communicating with said manifold space;

(d) said annular manifold space terminating at its downstream end in a gas discharge orifice;

(e) said metal jacketed refractory block forming a gas-tight joint with the upstream end of said pouring tube; and (f) said gas discharge orifice being arranged to eject gas supplied to said manifold space in a downstream direction substantially along the inner wall of said pouring tube.

2. Apparatus according to claim 1 in which said pouring tube has an upwardly divergent upstream end and in which the external surface of said union converges downwardly for gas-tight reception in said pouring tube upstream end.

3. Apparatus according to claim 1 or claim 2 in which said gas discharge orifice is annular.

4. Apparatus according to claim 3 in which said manifold space contains a filling of gas porous material.

5. Apparatus according to claim 4 in which said gas porous material comprises a fibrous ceramic substance.

6. Apparatus according to claim 5 in which said nozzle and the refractory block of said union interfit by way of a stepped joint, and including means to convey gas from said gas supply means to said stepped joint.

7. Apparatus according to claim 6 in which said nozzle is surrounded by a metal encasement having an annular depending extension therefrom and in which said gas conveying means comprises an annular space between said metal jacket and said extension.

8. Apparatus according to claim 7 including shoulder means on the external surface of said union, a coupling ring having an inturned lip abutting said shoulder means, said ring coacting with said depending nozzle extension to secure said union to the downstream end of said nozzle.

9. Apparatus for use in submerged pouring of molten metals, comprising a nozzle leading downstream to an elongated submerged pouring tube, the nozzle having, at least at its downstream end, a metal jacket spaced therefrom to define an annular manifold space, a gas supply pipe communicating with said manifold space, and gas discharge orifice means at the said end of the nozzle, the nozzle and its metal jacket forming a gas-tight joint with the upstream end of the pouring tube, and said orifice means being arranged to eject gas fed into the manifold space in a direction substantially along the inner wall of the pouring tube.

10. Apparatus according to claim 9, wherein said pouring tube has an outwardly divergent flared opening at the upstream end thereof and the nozzle and its jacket taper inwardly in the downstream direction to be gas-tightly received in said flared opening.

* * * * *